US009608355B2

(12) United States Patent
Nagai et al.

(10) Patent No.: US 9,608,355 B2
(45) Date of Patent: Mar. 28, 2017

(54) CONNECTOR HAVING A RETAINER WITH OUTER SURFACE FLUSH WITH OUTER SURFACE OF THE CONNECTOR HOUSING

(71) Applicant: YAZAKI CORPORATION, Tokyo (JP)

(72) Inventors: Kentaro Nagai, Shizuoka (JP); Yoshimi Wada, Shizuoka (JP); Naokazu Nagasaka, Shizuoka (JP); Dacheng Jin, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/161,818

(22) Filed: May 23, 2016

(65) Prior Publication Data

US 2016/0352035 A1 Dec. 1, 2016

(30) Foreign Application Priority Data

May 28, 2015 (JP) ..... 2015-108754
May 28, 2015 (JP) ..... 2015-108755

(51) Int. Cl.
*H01R 13/40* (2006.01)
*H01R 13/436* (2006.01)
*H01R 13/422* (2006.01)

(52) U.S. Cl.
CPC ..... *H01R 13/4361* (2013.01); *H01R 13/4223* (2013.01)

(58) Field of Classification Search
CPC ..... H01R 13/4223; H01R 13/4226; H01R 13/4361; H01R 13/4362
USPC ..... 439/595
See application file for complete search history.

(56) References Cited

U.S. PATENT DOCUMENTS 4,679,874 A * 7/1987 Saijo ..... H01R 13/422 439/595
5,106,326 A * 4/1992 Tsuji ..... E05D 1/02 220/275
5,160,283 A * 11/1992 Fry ..... H01R 13/4362 439/752
6,000,967 A * 12/1999 Norizuki ..... H01R 13/4362 439/596
6,126,484 A * 10/2000 Klein ..... H01R 13/4223 439/157

(Continued)

FOREIGN PATENT DOCUMENTS

JP 8-17504 A 1/1996
JP 2001-332333 A 11/2001

*Primary Examiner* — Chandrika Prasad
(74) *Attorney, Agent, or Firm* — Kenealy Vaidya LLP

(57) ABSTRACT

A connector includes a terminal, a housing body haying a terminal housing chamber inside which the terminal is housed, an opening portion formed at an outer peripheral surface of the housing body, a retainer having a locking protrusion that protrudes into the terminal housing chamber to lock the terminal housed in the terminal housing chamber when the retainer is fitted to the opening portion, and a hinge that connects the retainer to the housing body so as to allow the retainer to turn between an open position at which the opening portion is opened and a closed position at which the retainer is fitted to the opening portion to close the opening portion. When the retainer is in the closed position, an outer surface of the retainer is flush with the outer peripheral surface of the housing body.

8 Claims, 8 Drawing Sheets

(56) References Cited

U.S. PATENT DOCUMENTS

| | | | | |
|---|---|---|---|---|
| 6,328,614 | B1 * | 12/2001 | Osawa | H01R 13/4223 439/752 |
| 7,384,318 | B2 * | 6/2008 | Lamdiziz | H01R 13/4368 439/816 |
| 7,862,374 | B2 * | 1/2011 | Ichio | H01R 13/4223 439/595 |
| 8,784,141 | B2 * | 7/2014 | Ishikawa | H01R 13/501 439/595 |
| 9,070,999 | B2 * | 6/2015 | Endo | H01R 13/506 |
| 9,331,419 | B2 * | 5/2016 | Yagi | H01R 13/4361 |
| 2009/0269963 | A1 * | 10/2009 | Brown | H01R 13/4223 439/357 |
| 2015/0333433 | A1 * | 11/2015 | Yagi | H01R 13/4361 439/701 |

* cited by examiner

CONNECTOR HAVING A RETAINER WITH OUTER SURFACE FLUSH WITH OUTER SURFACE OF THE CONNECTOR HOUSING

CROSS-REFERENCE TO RELATED APPLICATIONS

The present application claims priority from Japanese Patent Application Nos. 2015-108754 and 2015-108755 both filed on May 28, 2015, the entire contents of which are incorporated herein by reference.

FIELD OF INVENTION

The present invention relates to a connector provided with a terminal.

RELATED ART

A related art connector is coupled to a counterpart connector such that a terminal provided in a housing is electrically connected to a terminal of the counterpart connector. The connector has a retainer attached to the housing. The retainer is pushed into an opening portion of the housing so that the terminal can be locked by the retainer (see, e.g., JP2001-332333A and JPH08-17504A).

In this connector, a portion of the retainer locking the terminal protrudes from an outer peripheral surface of the housing, resulting in an increase in size. In addition, a housing of the counterpart connector has to be formed so as to conform to the retainer protruding from the outer peripheral surface. Therefore, the shape of the housing of the counterpart connector becomes complicated. Further, when coupling the connector to the counterpart connector, the retainer protruding from the outer periphery of the housing may hit the counterpart connector.

SUMMARY

Illustrative aspects of the present invention provide a connector capable of downsizing the connector, simplifying a housing of a counterpart connector, and facilitating a work for coupling the connectors to each other.

According to an illustrative aspect of the present invention, a connector includes a terminal, a housing body having a terminal housing chamber inside which the terminal is housed, an opening portion formed at an outer peripheral surface of the housing body, a retainer having a locking protrusion that protrudes into the terminal housing chamber to lock the terminal housed in the terminal housing chamber when the retainer is fitted to the opening portion, and a hinge that connects the retainer to the housing body an as to allow the retainer to turn between an open position at which the opening portion is opened and a closed position at which the retainer is fitted to the opening portion to close the opening portion. When the retainer is in the closed position, an outer surface of the retainer is flush with the outer peripheral surface of the housing body.

According to another illustrative aspect of the present invention, the outer surface of the retainer may not be flush with the outer peripheral surface of the housing body when the retainer is in the closed position, but the retainer has a base end at which the retainer is connected to the housing body via the hinge and a free end on a side opposite to the base end, the free end being opposed to a locking surface forming the opening portion in a state in which the retainer is in the closed position, one of the free end of the retainer and the locking surface of the opening portion has at least on locking portion at which the other of the free end of the retainer and the locking surface of the opening portion is locked, and one of the free end of the retainer and the locking surface of the opening portion has a recessed portion that forms a hole portion between the recessed portion and the other of the free end of the retainer and the locking surface of the opening portion. According to this configuration, the retainer can be reliably locked thereby locking the terminal, and the retainer can be opened easily when necessary.

Other aspects and advantages of the invention will be apparent from the following description, the drawings and the claims.

DETAILED DESCRIPTION

Hereinafter, exemplary embodiments of the present invention will be described in detail with reference to the drawings. However, the following exemplary embodiments do not limit the scope of the claimed invention.

Figure 1A:
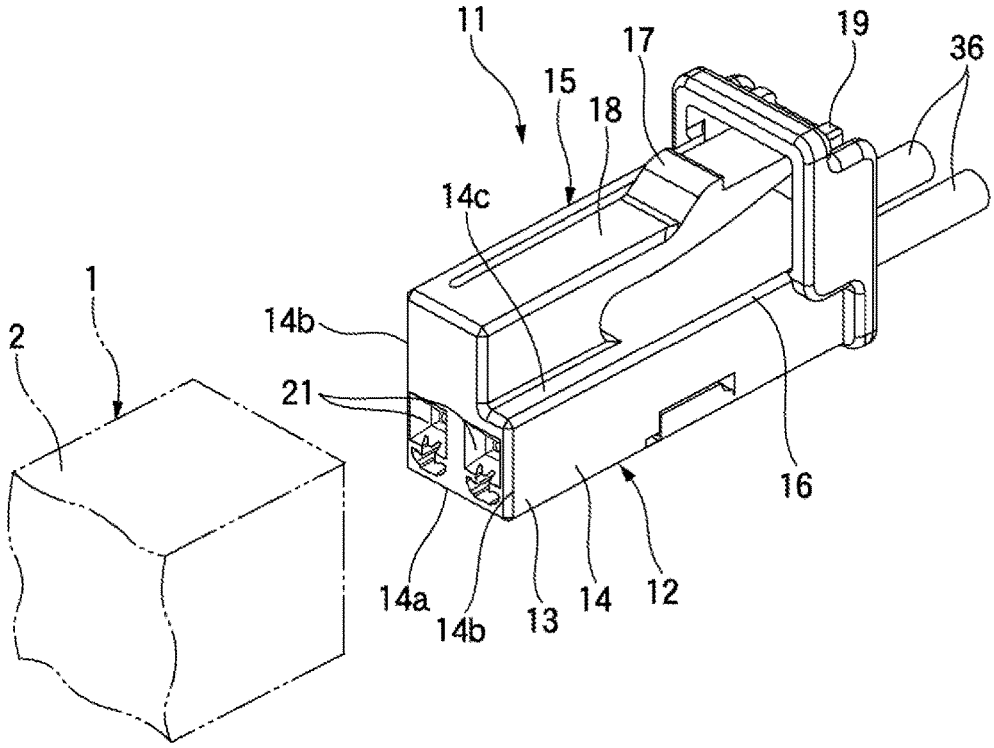
FIG. 1A is a perspective view of a connector according to an exemplary embodiment of the present invention observed from the front side of the connector.
Figure 1B:
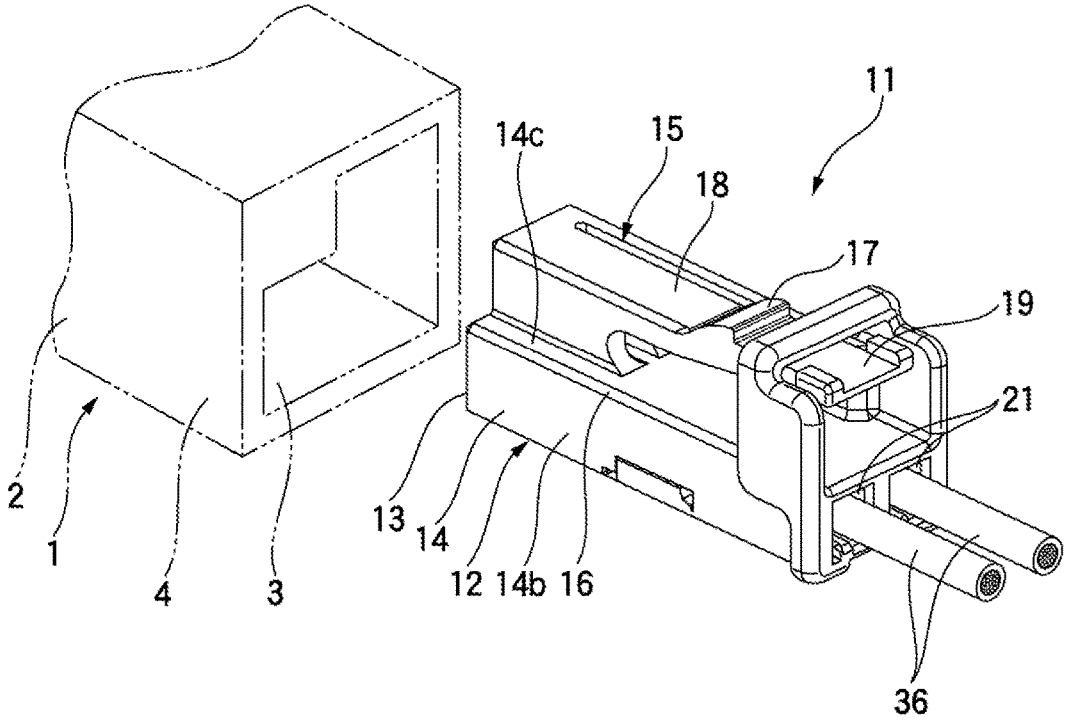
FIG. 1B is a perspective view of the connector observed from the rear side of the connector.

As shown in FIGS. 1A and 1B, a connector 11 according to the exemplary embodiment of the invention has a female housing 12 made of a resin molded product, and a counterpart connector 1 has a male housing (housing) 2 made of a resin molded product. The female housing 12 has a fitting portion 13 on its distal end side, which is the front side in the direction in which the connector 11 is coupled to the counterpart connector 1. The male housing 2 has a fitting recessed portion 3 on its distal end side, which is the front side in the direction in which the connector 1 is coupled to the connector 11. The male housing 2 has a hood portion 4. The inside of the hood portion 4 serves as the fitting recessed portion 3. When the fitting portion 13 of the female housing 12 is fitted to the fitting recessed portion 3 of the male housing 2, the connector 11 is coupled to the counterpart connector 1.

The female housing 12 has a housing body 14 and a lock portion 15. The housing body 14 is formed into a sectionally rectangular shape including a bottom wall 14*a*, side walls 14*b* and atop wall 14*c*. The lock portion 15 is formed integrally with the upper wall 14*c* side in the housing body 14. The lock portion 15 is formed in a position biased to one side relatively to the housing body 14. Thus, the female housing 12 is formed into an asymmetric shape in front view. Each corner 16 of the housing body 14 is chamfered along the front/rear direction.

A lock arm 18 including a lock claw 17 is formed in the lock portion 15. When the lock arm 18 is fitted to the fitting recessed portion 3 of the male housing 2 of the counterpart connector 1, the lock claw 17 locks an engagement hole (not shown) formed in the hood portion 4 of the male housing 2, and keeps the fitting state of the female housing 12 to the male housing 2. A pressing portion 19 is formed in a rear end portion of the lock art 18. When the pressing portion 19 is pressed, the lock arm 18 is elastically deformed to unlock the lock claw 17.

Figure 2:
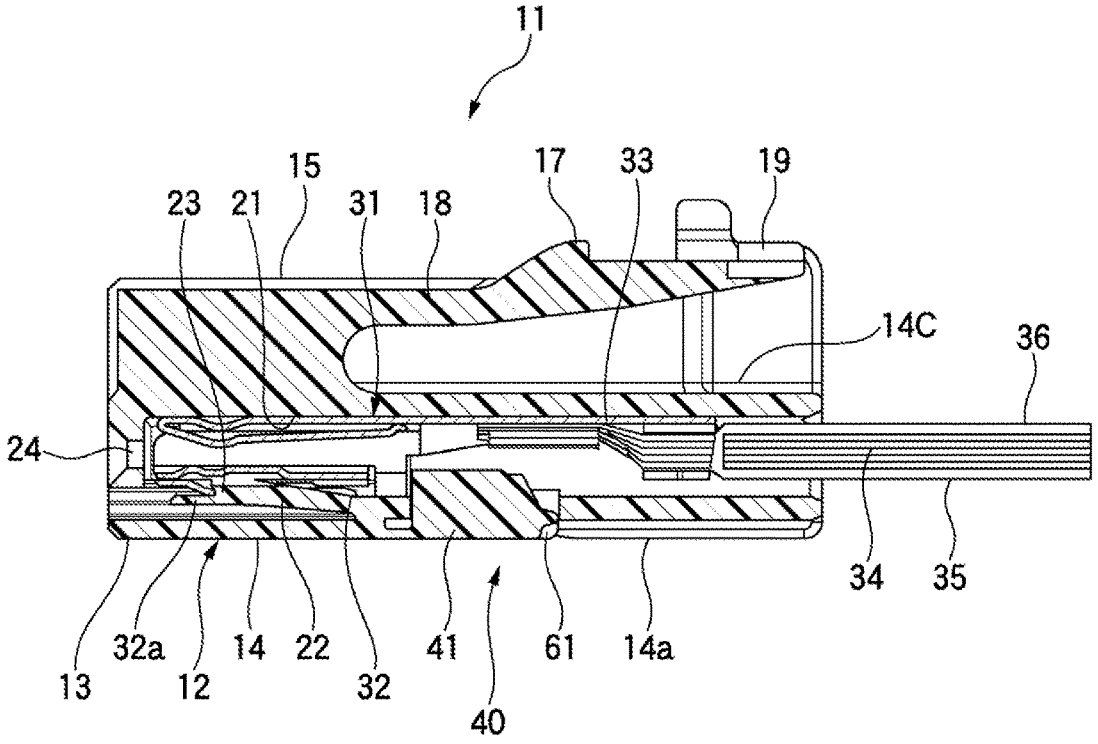
FIG. 2 is a sectional view of the connector taken along the longitudinal direction of the connector.

As shown in FIG. 2, the housing body 14 of the female housing 12 has two terminal housing chambers 21. The terminal housing chambers 21 are formed to extend in the direction in which the connector 11 is coupled to the counterpart connector 1. The terminal housing chambers 21 are arranged in parallel. Each terminal housing chamber 21 has a lance portion 22 near the front end of the housing body 14, The rear end side of the lance portion 22 is connected to the housing body 14. The lance portion 22 has a protrusion portion 23 protruding toward a corresponding one of the terminal housing chambers 21. The protrusion portion 23 is disposed in the terminal housing chamber 21. On the other hand, each terminal housing chamber 21 has an insertion hole 24 on the front end side of the housing body 14.

A female terminal (terminal) 31 is housed into each terminal housing chamber 21 from the rear end side, which is the rear side in the direction in which the connector 11 is coupled to the counterpart connector 1. The female terminal 31 is, for example, formed out of a conductive metal material such as copper or a copper alloy. The female terminal 31 has an electric connection portion 32 and a crimping portion 33. An insulated wire 36 in which a conductor 34 is covered with a jacket 35 is crimped and electrically connected to the crimping portion 33. When the female terminal 31 is inserted into the terminal housing chamber 21 from the rear end side of the housing body 14, a lock claw 32*a* formed in the electric connection portion 32 is locked to the protrusion portion 23 of the lance portion 22, Thus, the female terminal 31 is retained to be housed in the terminal housing chamber 21. The electric connection portion 32 of the female terminal 31 is formed into a cylindrical shape. A tab of a male terminal provided in the counterpart connector 1 inserted from the insertion hole 24 of the housing body 14 is inserted and electrically connected to the insertion hole 24.

Figure 3:
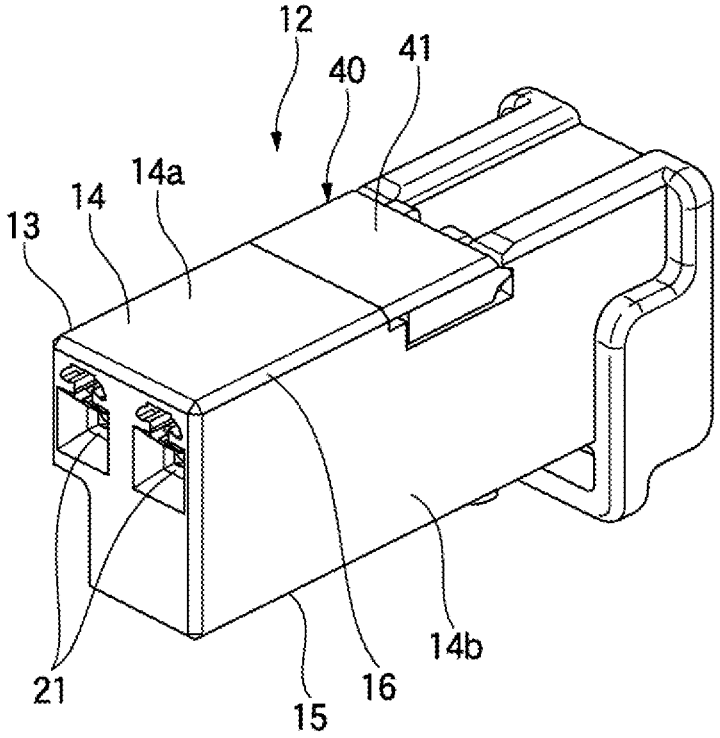
FIG. 3 is a perspective view of a female housing with the bottom wall side of the female housing directed upward.
Figure 4A:
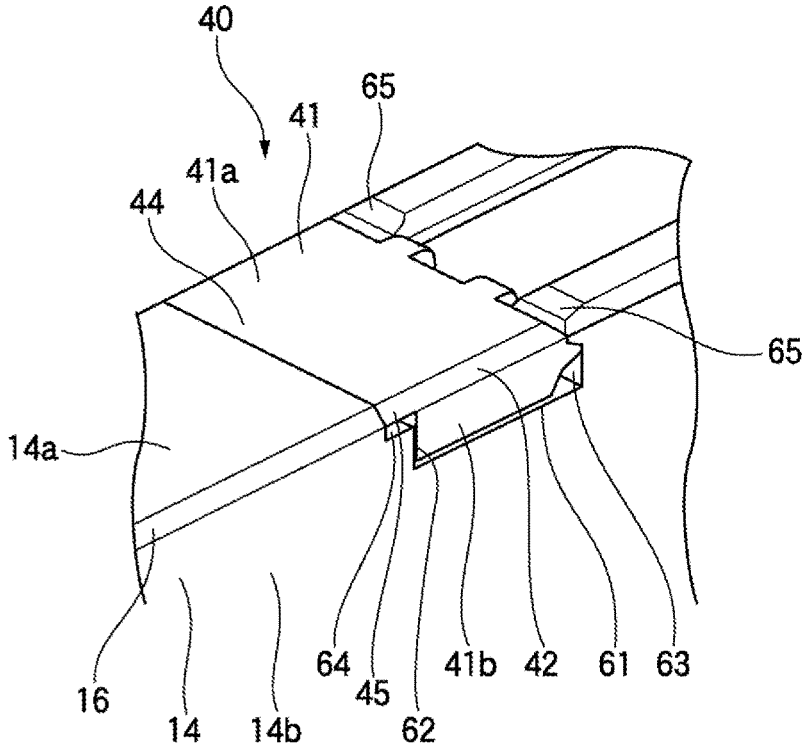
FIG. 4A is a perspective view of a terminal retention portion of a housing body observed from the front end side of the housing body in a state in which a retainer has been disposed in a closed position.
Figure 4B:
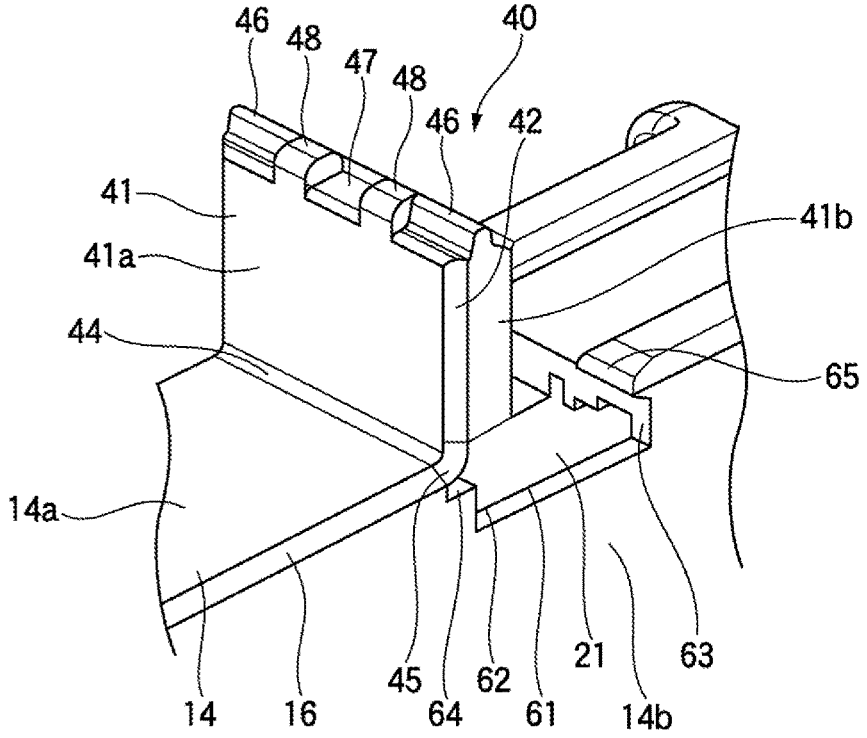
FIG. 4B is a perspective view of the terminal retention portion observed from the front end side of the housing body in a state in which a retainer has been disposed in an open position.
Figure 5A:
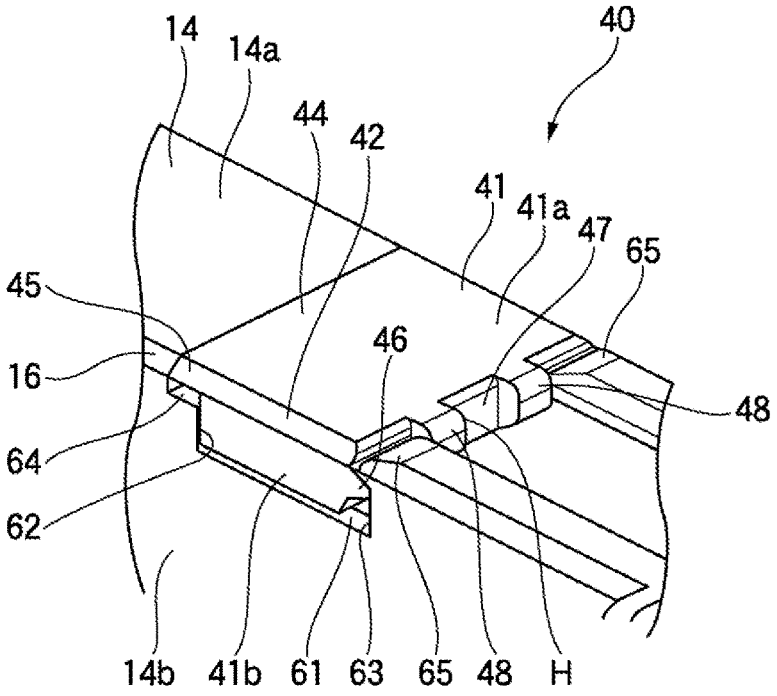
FIG. 5A is a perspective view of the terminal retention portion observed from the rear end side of the housing body in a state in which a retainer has been disposed in the closed position.
Figure 5B:
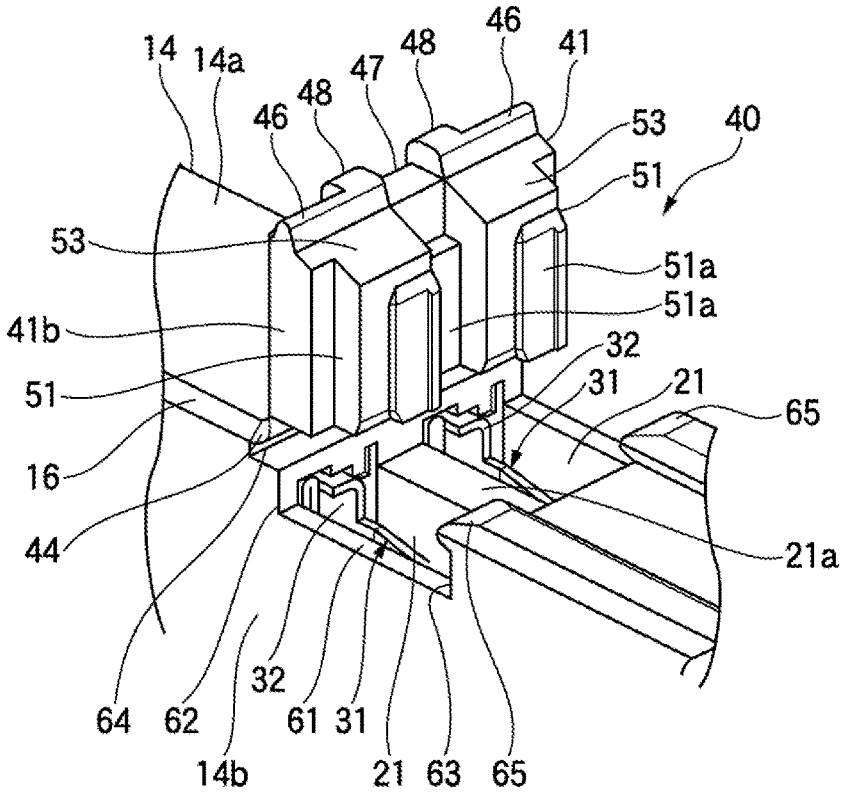
FIG. 5B is a perspective view of the terminal retention portion observed from the rear end side of the housing body in a state in which a retainer has been disposed in the open position.
Figure 6A:
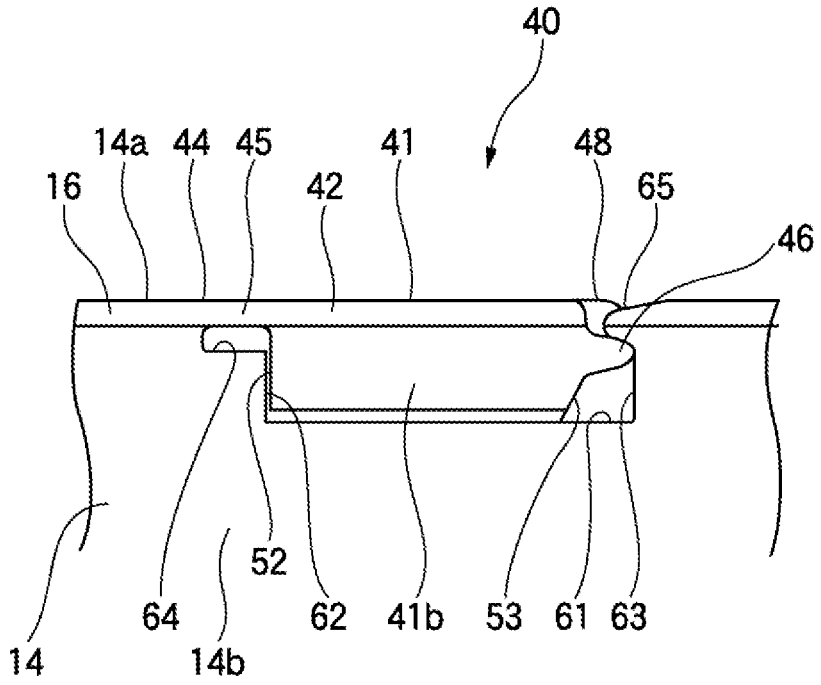
FIG. 6A is a side view of the terminal retention portion in a state in which the retainer has been disposed in the closed position.
Figure 6B:
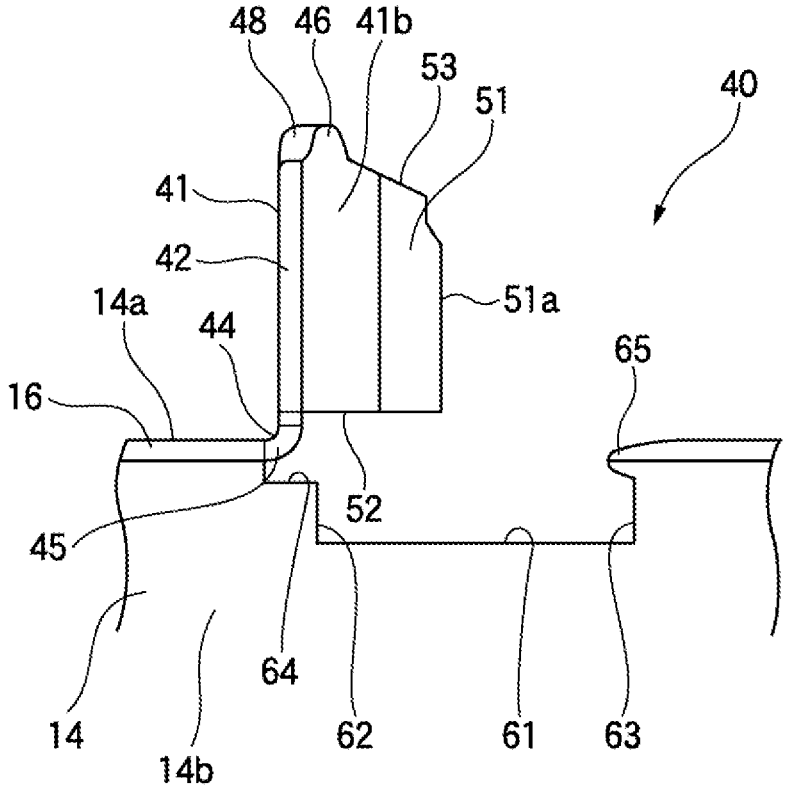
FIG. 6B is a side view of the terminal retention portion in a state in which the retainer has been disposed in the open position.
Figure 7A:
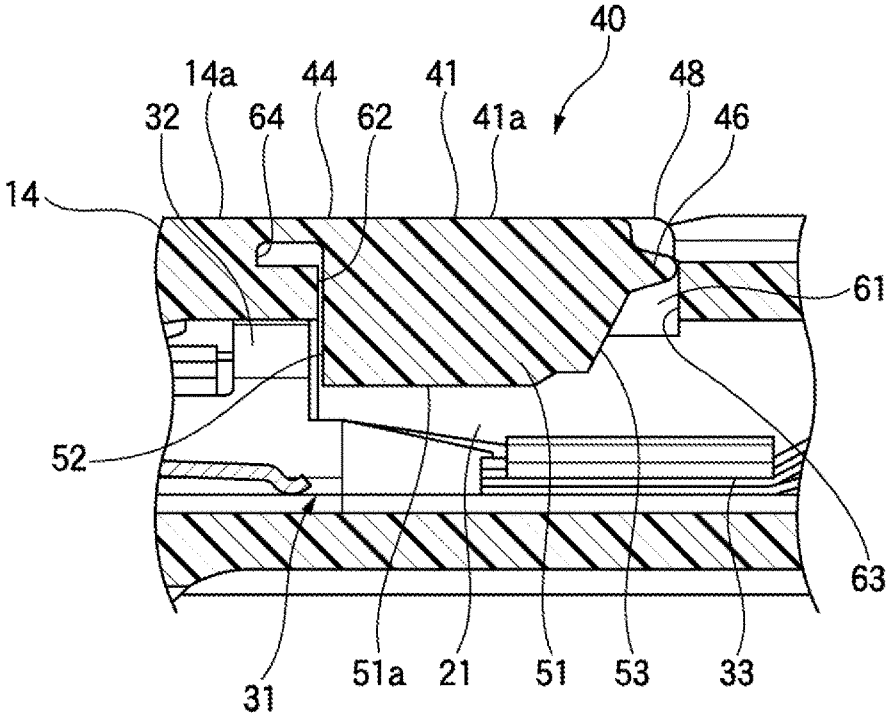
FIG. 7A is a sectional view of the terminal retention portion in a state in which the retainer has been disposed in the closed position.
Figure 7B:
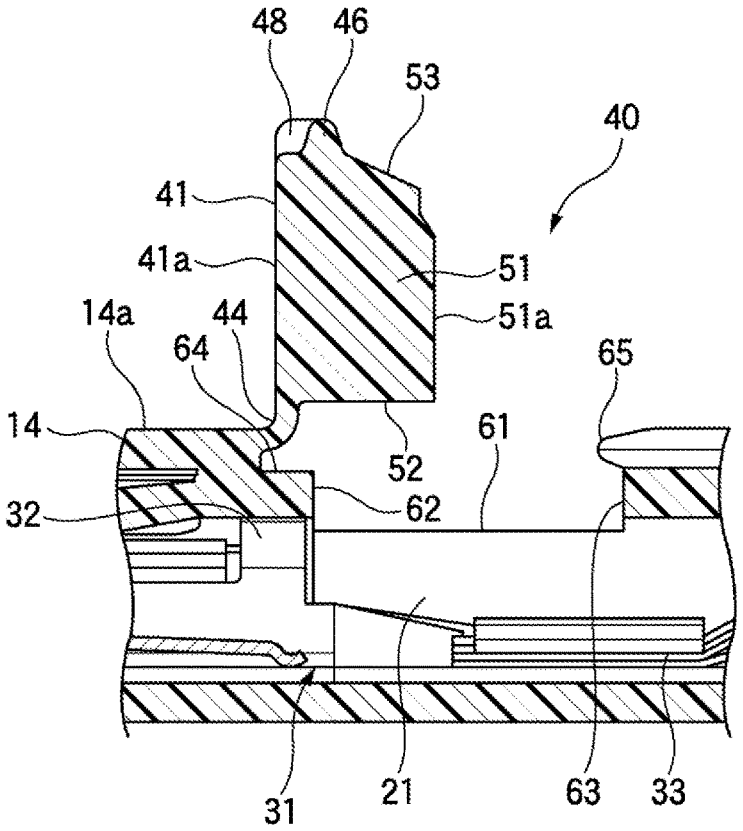
FIG. 7B is a sectional view of the terminal retention portion in a state in which the retainer has been disposed in the open position.

As shown in FIG. 3, a terminal retention portion 40 having a retainer 41 is provided on the bottom wall 14*a* side in a longitudinally intermediate portion of the housing body 14 having the terminal housing chambers 21. The retainer 41 of the terminal retention portion 40 is formed integrally with the housing body 14.

Next, description will be made about the terminal retention portion 40 of the housing body 14.

As shown in FIGS. 4A to 5B, an opening portion 61 is formed in the bottom wall 14*a* of the housing body 14. Thus, a longitudinally intermediate portion of each terminal housing chamber 21 formed in the housing body 14 is opened at the opening portion 61, from which the crimping portion 33 side of the female terminal 31 housed in the terminal housing chamber 21 is exposed.

As shown in FIG. 6A to 7B, since the opening portion 61 is formed in the housing body 14, a part of the bottom wall 14*a* is removed, while parts of the side walls 14*b* on the sectionally opposite sides and a part of a partition wall 21*a* separating the terminal housing chambers 21 from each other are removed and recessed. Of the opening portion 61 formed in the housing body 14, a wall surface on the front end side of the housing body 14 is formed as a rotation regulating surface 62, and a wall surface on the rear end side of the housing body 14 is formed as a locking surface 63. The rotation regulating surface 62 is disposed to be flush with or slightly on the rear end side from the rear end positions of the electric connection portions 32 of the female terminals 31 housed in the terminal housing chambers 21 and locked to the lance portions 22. In addition, in the opening portion 61, a step portion 64 is formed at an edge portion of a wall surface on the front end side of the housing body 14. A pair of locking portions 65 are formed at an edge portion of the locking surface 63. The locking portions 65 are formed on the opposite side portion sides of the housing body 14. Each locking portion 65 protrudes toward the front end of the housing body 14.

The retainer 41 is formed into a sectionally rectangular shape, including a bottom wall portion 41*a*, and side wall portions 41*b*. A chamfered portion 42 is formed in a corner between the bottom wall portion 41*a* and each side wall portion 41*b*. A hinge 44 is provided between the retainer 41 and the housing body 14. The hinge 44 is connected to an edge portion of the step portion 64 formed in the opening portion 61, and an end portion of the retainer 41 on the front end side of the housing body 14. Thus, the end portion of the retainer 41 on the front end side of the housing body 14 is connected to the housing body 14 via the hinge 44 over the entire widthwise direction. Chamfered portions 45 are formed in opposite side portions of the hinge 44.

The housing body 14, the retainer 41 and the hinge 44 are formed integrally. The hinge 44 is formed to be thin enough to be deformed. Thus, the retainer 41 can be rotated around a widthwise axis relatively to the housing body 14 and with the end portion on the front end side of the housing body 14 as a base end.

The opening portion 61 of the housing body 14 is opened when the retainer 41 is turned to leave the housing body 14. The opening portion 61 is closed when the retainer 41 is turned toward the housing body 14. In this manner, the retainer 41 can be moved to an open position at which the opening portion 61 is opened (see FIG. 4B), and a closed position at which the opening portion 61 is closed (see FIG. 4A).

In a state in which the retainer 41 is in the closed position to close the opening portion 61, the surface of the bottom wall 14*a* of the housing body 14 is flush with the surface of the bottom wall portion 41*a* of the retainer 41, and the surfaces of the side walls 14*b* of the housing body 14 are flush with the surfaces of the side wall portions 41*b* of the retainer 41. Further, in a state in which the retainer 41 has been disposed in the closed position to close the opening portion 61, the chamfered portions 42 of the retainer 41 and the chamfered portions 45 of the hinge 44 are linearly continuous to the chamfered corners 16 of the housing body 14. In this manner, in the closed position at which the opening portion 61 is closed, the retainer 41 is fitted to the opening portion 61 without protruding from the outline of the housing body 14. The retainer 41 disposed in the closed position constitutes apart of the exterior wall of the housing body 14. In addition, when the retainer 41 is disposed in the closed position and fitted to the opening portion 61, the retainer 41 closes the opening portion 61 of the housing body 14 to form a part of each terminal housing chamber 21 of the housing body 14.

The retainer 41 has a pair of lock claws 46 at its free end on the side opposite to the side at which the retainer 41 is connected to the housing body 14 by the hinge 44. Each lock claw 46 is formed into a sectionally tapered shape in which the thickness is reduced as it goes toward the distal end. The lock claws 46 are formed on the opposite side portion sides of the retainer 41. Further, a jig hole forming recessed portion (recessed portion) 47 is formed at the widthwise center of the free end of the retainer 41. In addition, a thick walled portion 48 is formed between each lock claw 46 and the jig hole forming recessed portion 47 at the free end of the retainer 41. The thick walled portion 48 is formed to be thicker than the tapered lock claw 46.

In a state in which the retainer 41 is disposed in the closed position to close the opening portion 61, the lock claws 46 are locked to the locking portions 65 on the housing body 14 side. Thus, the retainer 41 is kept in a state in which the retainer 41 is fitted into the opening portion 61. When the retainer 41 is disposed in the closed position, the free end of the retainer 41 is disposed in a position opposed to the locking surface 63 of the opening portion 61, and the thick walled portions 48 of the retainer 41 are disposed on the locking surface 63 of the opening portion 61 without any clearance. In addition, when the retainer 41 is disposed in the closed position, a jig hole (hole portion) H surrounded by the jig hole forming recessed portion 47 and the locking surface 63 of the opening portion 61 is formed between the retainer 41 and the locking surface 63. A rod-like jig (not shown) can be inserted into the jig hole H. The jig is inserted into the jig hole H, and the distal end of the jig is locked to the surface of the retainer 41 opposite to the bottom wall portion 41*a*. When the retainer 41 is thus pulled up by the jig, the locking state between each lock claw 46 and each locking portion 65 can be canceled.

Here, the jig hole forming recessed portion 47 is surrounded by the thick walled portions 48 on the opposite sides thereof. Accordingly, the distal end of the rod-like jig inserted into the jig hole H formed by the jig hole forming recessed portion 47 and the locking surface 63 is guided by the thick walled portions 48 in a predetermined direction toward the partition wall 21*a* just under the jig hole H so that the distal end of the jig can be brought into contact with the partition wall 21*a*. Thus, such a defect that the jig inserted into the jig hole H may enter into the terminal housing chamber 21 so as to touch and damage the crimping portion 33 of the female terminal 31 can be suppressed surely.

The retainer 41 has a pair of locking protrusions 51 on the opposite side to the bottom wall portion 41*a*. The locking protrusions 51 are formed to extend in the longitudinal direction of the retainer 41. Each locking protrusion 51 has a width slightly smaller than the width of each terminal housing chamber 21 of the housing body 14. Of each locking protrusion 51, the end surface on the base end side of the retainer 41 connected to the hinge 44 is formed as a contact surface 52. In addition, of the locking protrusion 51, the end surface on the free end side opposite to the base end side is formed as a flank 53 that is gradually inclined toward the base end as it goes in the protruding direction. A bottom surface 51*a* of the locking protrusion 51 is formed to have a protruding size as large as possible within a range in which the bottom surface 51*a* can be prevented from abutting against the female terminal 31 housed in the terminal housing chamber 21.

When the retainer 41 in the open position is turned to the closed position so that the retainer 41 can be fitted to the opening portion 61, each locking protrusion 51 enters a corresponding one of the terminal housing chambers 21 of the housing body 14 to be thereby fitted thereto. In this state, the contact surface 52 of the locking protrusion 51 abuts against the rotation regulating surface 62 of the opening portion 61 so that the rotation of the retainer 41 can be regulated. The locking protrusion 51 fitted to the terminal housing chamber 21 is disposed on the rear end side of the electric connection portion 32 of the female terminal 31 housed in the terminal housing chamber 21 and locked to the lance portion 22. Thus, the female terminal 31 housed in the terminal housing chamber 21 is locked by the lance portion 22 while the electric connection portion 32 is locked by the locking protrusion 51 of the retainer 41. In addition, when the retainer 41 is disposed in the closed position, the locking protrusions 51 are fitted to the terminal housing chambers 21 respectively, and the partition wall 21*a* separating the terminal housing chambers 21 from each other is fitted between the locking protrusions 51. Thus, the widthwise movement of the retainer 41 relative to the housing body 14 is also regulated.

In addition, of the locking protrusions 51, the end surfaces on the free end side are formed as the flanks 53 gradually inclined toward the base end as going in the protruding direction. Accordingly, when the retainer 41 is turned to the closed position, the locking protrusions 51 can be fitted to the terminal housing chambers 21 without interfering with the locking portions 65 of the locking surface 63 of the opening portion 61.

Next, description will be made about a case where the female terminal 31 is attached to the housing body 14 of the female housing 12.

Figure 8:
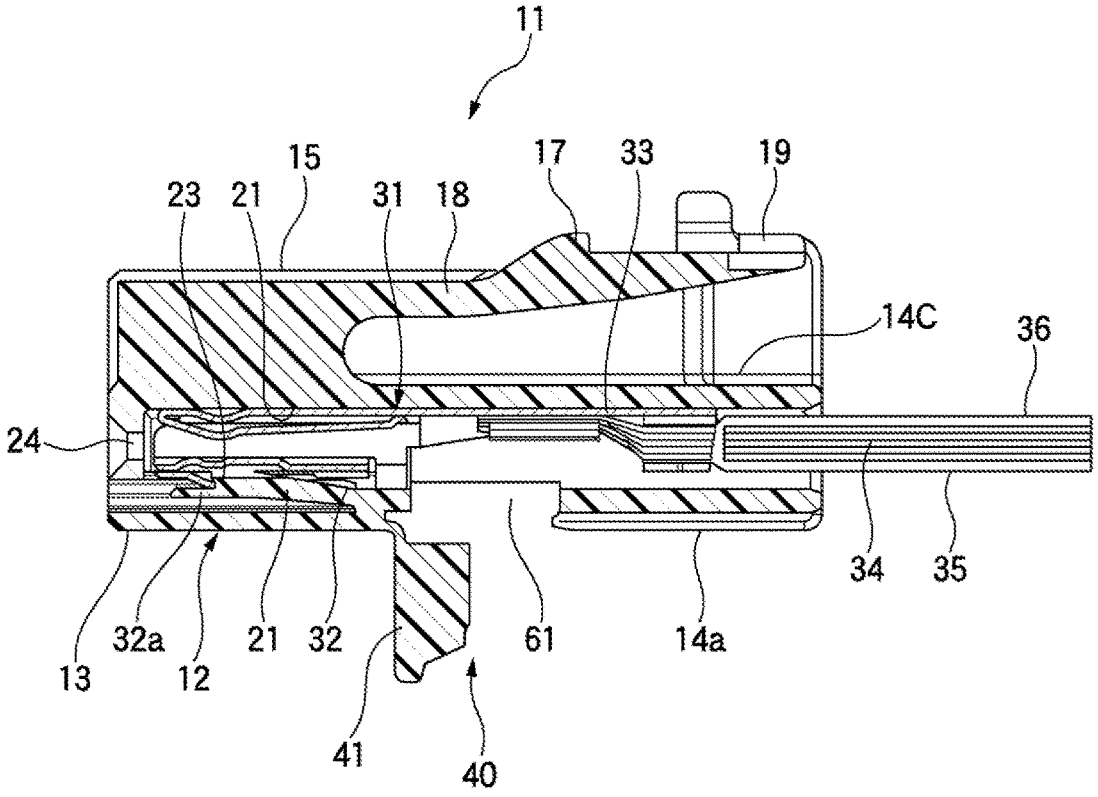
FIG. 8 is a sectional view of the connector taken along the longitudinal direction of the connector for the sake of explanation about attachment of a female terminal to the housing body.

As shown in FIG. 8, the female terminal 31 whose bottom portion side is directed upward is inserted into the terminal housing chamber 21 of the housing body 14 from the rear end side in a state in which the retainer 41 has been disposed in the open position. When the female terminal 31 is inserted into the terminal housing chamber 21 in this manner, the protrusion portion 23 of the lance portion 22 formed in the housing body 14 locks the locking claw 32*a* formed in the electric connection portion 32 of the female terminal 31. Thus, the female terminal 31 is housed in the terminal housing chamber 21 in a state in which the female terminal 31 is locked and prevented from dropping off by the lance portion 22.

Next, the retainer 41 in the open position is turned toward the closed position, and the retainer 41 is fitted into the opening portion 61 of the housing body 14. Thus, the locking protrusion 51 of the retainer 41 enters a corresponding one of the terminal housing chambers 21 of the housing body 14 so as to be fitted thereto. The rear end of the electric connection portion 32 of the female terminal 31 housed in the terminal housing chamber 21 is locked by the contact surface 52 of the locking protrusion 51 of the retainer 41.

In this manner, in the connector 11, the female terminal 31 is doubly locked by the lance portion 22 of the housing body 14 and the locking protrusion 51 of the retainer 41. Accordingly, even when a tensile force acts on the insulated electric wire connected to the female terminal 31, the female terminal 31 does not drop off from the female housing 12 but can be kept in a state in which the female terminal 31 is housed in the terminal housing chamber 21.

Here, when the female terminal 31 is locked by the retainer 41, the female terminal 31 inserted into the terminal housing chamber 21 may be put in an incompletely locked state where the lance portion 22 is not locked to the female terminal 31. Even in such a case, the retainer 41 can be turned to the closed position so that the contact surface 52 of the locking protrusion 51 of the retainer 41 can abut against the rear end of the electric connection portion 32 of the female terminal 31 to thereby push the electric connection portion 32 toward the front end of the housing body 14. Thus, in the female terminal 31, the electric connection portion 32 can be surely doubly locked by the protrusion portion 23 of the lance portion 22 and the locking protrusion 51 of the retainer 41.

Next, the manner in which the connector is coupled to the counterpart connector 1 will be described.

To couple the connector 11 to the counterpart connector 1, the front end of the female housing 12 of the connector 11 is made close to the front end of the male housing 2 of the counterpart connector 1. Then the fitting portion 13 of the female housing 12 is inserted into the fitting recessed portion 3 of the hood portion 4 of the male housing 2.

Thus, tabs (not shown) of male terminals of the male housing 2 are inserted into and retained by the electric connection portions 32 of the female terminals 31 from the insertion holes 24 on the front end side of the housing body 14 of the female housing 12. Thus, the male terminals are electrically connected to the female terminals 31. In addition, in this state, the lock claw 17 of the lock arm 18 formed in the lock portion 15 of the female housing 12 locks an engagement hole formed in the hood portion 4 of the male housing 2 so as to maintain the coupled state between the female housing 12 and the male housing 2.

The female housing 12 is formed into an asymmetrical shape in front view. Accordingly, coupling to a male housing having a fitting recessed portion whose sectional shape is different from the sectional shape of the fitting portion 13 of the female housing 12 is prohibited. That is, the connector 11 can be coupled only to a regular counterpart connector 1.

Here, when coupling the connector 11 to the counterpart connector 1, there may be a a case where the retainer 41 is not completely fitted into the opening portion 51 of the housing body 14. Even in such a case, when the fitting portion 13 of the female housing 12 is fitted to the fitting recessed portion 3 of the hood portion 4 of the male housing 2, the hood portion 4 of the male housing 2 abuts against the bottom wall portion 41*a* of the retainer 41 so that the retainer 41 can be turned toward the housing body 14 to be thereby fitted into the opening portion 61 surely.

When the pressing portion 19 in the rear end portion of the lock arm 18 is pressed, the connector 11 coupled to the counterpart connector 1 in this manner can be removed from the counterpart connector 1. On this occasion, the whole of the lock arm 18 is elastically deformed to be bent so that the lock arm 18 can be released from being locked to the engagement hole by the lock claw 17.

In this state, the connector 11 is separated from the counterpart connector 1. Thus, the fitting portion 13 of the female housing 12 is pulled out from the fitting recessed portion 3 of the hood portion 4 of the male housing 2. As a result, the tabs of the male terminals are pulled out from the electric connection portions 32 of the female terminals 31 so that conductive connection between each female terminal 31 and each male terminal can be canceled.

In the connector 11 according to the exemplary embodiment, as has been described above, the retainer 41 is disposed in the closed position to be thereby fitted to the opening portion 61 of the housing body 14. Accordingly, the female terminals 31 housed in the terminal housing chambers 21 can be locked by the lance portions 22 and further locked by the lock convex portions 51 of the retainer 41.

In addition, when the retainer 41 is in the closed position, the outer surface of the retainer 41 is flush with the outer peripheral surface of the housing body 14 in a state in which the retainer 41 is fitted to the opening portion 61 to lock the female terminals 31. Due to this structure, the housing body 14 can be downsized. In addition, the shape of the housing 2 of the counterpart connector 1 can be simplified. Further, the retainer 41 can be prevented from protruding from the outer peripheral surface of the housing body 14. Thus, the connector 11 can be smoothly connected to the counterpart connector 1, thereby facilitating the work for coupling the connectors.

In addition, when the retainer 41 is disposed in the closed position in the housing body 14 having the chamfered corners 16, the chamfered portions 42 and 45 of the retainer 41 and the hinge 44 can be made continuous to the chamfered parts of the corners 16 of the housing body 14. Accordingly, the corners 16 can be prevented from protruding from the housing body 14. Thus, work for coupling to the counterpart connector 1 can be performed more smoothly.

In addition, the retainer 41 disposed in the closed position forms a part of the exterior wall of the housing body 14 and the interior walls of the terminal housing chambers 21. That is, the retainer 41 locking the female terminals 31 can be formed as a member forming the exterior wall of the housing body 14 and the interior walls of the terminal housing chambers 21.

In addition, the front side of the retainer 14 in the direction in which the housing body 14 is fitted to the hood portion 4 is connected to the housing body 14 via the hinge 44. Accordingly, even in a state in which the retainer 41 is not completely fitted to the opening portion 61, by coupling the connector 11 to the counterpart connector 1, the retainer 41 can be turned by the edge portion of the hood portion 4 of the counterpart connector 1 and fitted to the opening portion 61.

In addition, when the retainer 41 is disposed in the closed position, the free end of the retainer 41 can be locked to the locking surface 63 of the opening portion 61 by the locking portions 65 so that the retainer 41 can be fixed to the housing body 14 surely. In addition, when the retainer 41 is disposed in the closed position, the jig hole H is formed between the free end of the retainer 41 and the locking surface 63 of the opening portion 61. Accordingly, when the jig is inserted into the jig hole H to separate the retainer 41 from the housing body 14, the retainer can be released from being locked by the locking portions 65, and can be turned to the open position. Thus, if necessary, the retainer 41 can be easily opened for example to reattach the female terminals 31.

In addition, of the retainer 41, the end portion of the retainer 14 on the front side in the direction in which the female terminals 31 are inserted to the terminal housing chambers 21 serves as a base end at which the retainer 41 is connected to the housing body 14 via the hinge 44. Accordingly, when the retainer 41 is turned toward the closed position, the female terminals 31 that have not been completely inserted into the terminal housing chambers 21 can be pushed forward in the insertion direction by the locking protrusions 51 and housed in predetermined positions by the lance portions 22.

In addition, when an insulated wire 36 connected to a female terminal 31 is pulled to apply a tensile force to the female terminal 31 in a direction to make the female terminal 31 drop out from the corresponding terminal housing chamber 21, the thick walled portions 48 of the retainer 41 abut against the locking surface 63 of the opening portion 61 so as to confront the tensile force. Accordingly, the force with which the female terminal 31 is locked by the retainer 41 can be enhanced.

In addition, the rotation regulating surface 62 against which the locking protrusions 51 of the retainer 41 can abut to regulate the rotation of the retainer 41 is provided in the opening portion 61, and the rotation regulating portion 62 is disposed in the locking position at which the female terminals 31 are locked by the locking protrusions 51 of the retainer 41. Accordingly, when the retainer 41 is turned to the closed position, the locking protrusions 51 of the retainer 41 can be brought into contact with the rotation regulating surface 62 of the opening portion 61 so that the locking protrusions 51 of the retainer 41 can be positioned and disposed in the locking positions of the female terminals 31.

In the aforementioned exemplary embodiment, the two locking portions 65 for locking the retainer 41 are formed on the widthwise opposite sides of the locking surface 63 of the opening portion 61, and the jig hole forming recessed portion 47 serving as the jig hole H is formed at the widthwise center of the free end of the retainer 41. However, one locking portion 65 may be formed at the widthwise center of the locking surface 63, and jig hole forming recessed portions 47 serving as jig holes H may be formed on the widthwise opposite sides of the free end of the retainer 41.

In addition, in the aforementioned exemplary embodiment, the locking portions 65 for locking the retainer 41 are formed in the locking surface 63 of the opening portion 61, and the jig hole forming recessed portion 47 serving as the jig hole H is formed at the free end of the retainer 41. However, the locking portions 65 for locking the locking surface 63 may be formed at the free end of the retainer 41, and the jig hole forming recessed portion 47 serving as the jig hole H may be formed in the locking surface 63 of the opening portion 61.

However, when the jig hole forming recessed portion 47 serving as the jig hole H is formed in the locking surface 63 of the opening portion 61, the jig hole forming recessed portion 47 has to be undercut. Accordingly, molds for molding the female housing 12 are complicated. On the other hand, when the jig hole forming recessed portion 47 is formed at the free end of the retainer 41, the female housing 12 can be molded by molds for molding the front end side and the rear end side parted in the position of the retainer 41 disposed in the open position, and a slide for forming the opening portion 61. Accordingly, when the jig hole forming recessed portion 47 is formed at the free end of the retainer 41, the number of molds for molding the female housing 12 can be reduced, and the shapes of the molds can be simplified. Thus, the equipment cost can be reduced.

The corners 16 of the housing body 14, and the chamfered portions 42 and 45 of the retainer 41 and the hinge 44 may be chamfered by simply cutting off the edges by beveling or by rounding the edges.

In addition, in the aforementioned exemplary embodiment, description has been made along the example in which the connector 1 is provided with the female housing 12 having an asymmetrical shape in front view. However, not to say, the invention may be also applied to a connector provided with a female housing 12 having asymmetrical shape in front view.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

As described above, according to as illustrative aspect of the invention, a connector (11) includes a terminal (e.g., the female terminal 31), a housing body (14) having a terminal housing chamber (21) inside which the terminal is housed, an opening portion (61) formed at an outer peripheral surface of the housing body, a retainer (41) having a locking protrusion (51) that protrudes into the terminal housing chamber to lock the terminal housed in the terminal housing chamber when the retainer is fitted to the opening portion, and a hinge (44) that connects the retainer to the housing body so as to allow the retainer to turn between an open position at which the opening portion is opened and a closed position at which the retainer is fitted to the opening portion to close the opening portion. When the retainer is in the closed position, an outer surface of the retainer is flush with the outer peripheral surface of the housing body.

The housing body may include a chamfered corner (16) extending in a longitudinal direction of the housing body, and the retainer and the hinge may each have a chamfered portion (42, 45) which extends continuously from the chamfered corner of the housing body when the retainer is in the closed position.

The retainer may form a part of an exterior wall of the housing body and a part of an interior wall of the terminal housing chamber in a state in which the retainer is in the closed position.

The housing body may be configured to fit into a hood portion (4) formed in a housing of a counterpart connector (1), and a front side of the retainer in a direction in which the housing body is fitted into the hood portion may be connected to the housing body via the hinge.

The retainer may have a base end at which the retainer is connected to the housing body via the hinge and a free end on a side opposite to the base end, the free end being opposed to a locking surface (63) forming the opening portion in a state in which the retainer is in the closed position, one of the free end of the retainer and the locking surface of the opening portion may have at least one locking portion (65) at which the other of the free end of the retainer and the locking surface of the opening portion is locked, and one of the free end of the retainer and the locking surface of the opening portion may have a recessed portion (jig hole forming recessed portion 47) that forms a hole portion (jig hole H) between the recessed portion and the other of the free end of the retainer and the locking surface of the opening portion. According to this configuration, the retainer can be reliably locked thereby locking the terminal, and the retainer can be opened easily when necessary. In terms of achieving this advantageous effect, the outer surface of the retainer does not need to become flush with the outer peripheral surface of the housing body when the retainer is in the closed position, The base end of the retainer may be on a front side of the retainer in a direction in which the terminal is inserted into the terminal housing chamber.

The free end of the retainer may have a thick walled portion (48) that abuts against the locking surface of the opening portion.

A rotation regulating surface (62) may be provided on a wall surface of the opening portion to which the retainer is connected via the hinge, the rotation regulating surface being configured to regulate a rotation of the retainer when the locking protrusion of the retainer abuts against the rotation regulating surface, and the rotation regulating surface may be provided at a locking, position of the terminal at which the terminal is locked by the locking protrusion of the retainer.

What is claimed is:

1. A connector comprising:

a terminal;

a housing body comprising a terminal housing chamber inside which the terminal is housed;

an opening portion formed at an outer peripheral surface of the housing body;

a retainer having a locking protrusion that protrudes into the terminal housing chamber to lock the terminal housed in the terminal housing chamber when the retainer is fitted to the opening portion; and a hinge that connects the retainer to the housing body so as to allow the retainer to turn between an open position at which the opening portion is opened and a closed position at which the retainer is fitted to the opening portion to close the opening portion, wherein, when the retainer is in the closed position, an outer surface of the retainer is flush with the outer peripheral surface of the housing body.

2. The connector according to claim 1, wherein the housing body further comprises a chamfered corner extending in a longitudinal direction of the housing body, and wherein the retainer and the hinge each has a chamfered portion which extends continuously from the chamfered corner of the housing body when the retainer is in the closed position.

3. The connector according to claim 1, wherein, in a state in which the retainer is in the closed position, the retainer forms a part of an exterior wall of the housing body and a part of an interior wall of the terminal housing chamber.

4. The connector according to claim 1, wherein the housing body is configured to fit into a hood portion formed in a housing of a counterpart connector to which the connector is coupled, and wherein a front side of the retainer in a direction in which the housing body is fitted into the hood portion is connected to the housing body via the hinge.

5. The connector according to claim 1, wherein the retainer comprises a base end at which the retainer is connected to the housing body via the hinge and a free end on a side opposite to the base end, the free end being opposed to a locking surface forming the opening portion in a state in which the retainer is in the closed position, wherein one of the free end of the retainer and the locking surface of the opening portion comprises at least one locking portion at which the other of the free end of the retainer and the locking surface of the opening portion is locked, and wherein one of the free end of the retainer and the locking surface of the opening portion comprises a recessed portion that forms a hole portion between the recessed portion and the other of the free end of the retainer and the locking surface of the opening portion.

6. The connector according to claim 5, wherein the base end of the retainer is on a front side of the retainer in a direction in which the terminal is inserted into the terminal housing chamber.

7. The connector according to claim 6, wherein the free end of the retainer comprises a thick walled portion that abuts against the locking surface of the opening portion.

8. The connector according to claim 6, wherein a rotation regulating surface is provided on a wall surface of the opening portion to which the retainer is connected via the hinge, the rotation regulating surface being configured to regulate a rotation of the retainer when the locking protrusion of the retainer abuts against the rotation regulating surface, and wherein the rotation regulating surface is provided at a locking position of the terminal at which the terminal is locked by the locking protrusion of the retainer.

* * * * *